US006930603B2

(12) United States Patent
Jackson

(10) Patent No.: US 6,930,603 B2
(45) Date of Patent: Aug. 16, 2005

(54) SENSOR LIGHT DEVICE

(76) Inventor: Ivette Jackson, 7727 Colony Lake Dr., Boynton Beach, FL (US) 33436

( * ) Notice: Subject to any disclaimer, the term of this patent is extended or adjusted under 35 U.S.C. 154(b) by 91 days.

(21) Appl. No.: 10/702,716

(22) Filed: Nov. 6, 2003

(65) Prior Publication Data

US 2004/0095251 A1 May 20, 2004

Related U.S. Application Data

(60) Provisional application No. 60/425,141, filed on Nov. 8, 2002.

(51) Int. Cl.[7] ..... G08B 1/08

(52) U.S. Cl. ..... 340/539.12; 340/286.07; 135/65

(58) Field of Search ..... 340/286.07, 326–330, 340/539.12, 565–566, 573.1, 825.19; 135/65–68

(56) References Cited

U.S. PATENT DOCUMENTS 5,554,975 A * 9/1996 Hall et al. ..... 340/573.7
6,166,644 A * 12/2000 Stroda ..... 340/573.4
6,356,210 B1 * 3/2002 Ellis ..... 340/990
6,384,728 B1 * 5/2002 Kanor et al. ..... 340/573.1

* cited by examiner

*Primary Examiner*—Jeffery Hofsass
*Assistant Examiner*—George A Bugg
(74) *Attorney, Agent, or Firm*—David P. Lhota; Stearns, Weaver, Miller, Weissler, Alhadeff & Sitterson, P.A.

(57) ABSTRACT

An automatic functioning light and warning system with remote signaling for use with mobility assistance devices, such as wheelchairs and walkers, having a housing, at least one detachable clamp connected to the housing, a battery-powered light incorporated into the housing, an internal audio alarm incorporated into the housing, an active or passive motion detection sensor and associated signal processing circuitry incorporated within the housing. The invention may use replaceable or rechargeable batteries as the power source. The remote receiver may be a stand alone device or interfaced into a monitoring system. A time delay circuit may be incorporated into the invention to automatically turn the light or alarm off at a predetermined time after activation and a sensor that prevents actuation of the light source when ambient light is above a predetermined threshold.

15 Claims, 1 Drawing Sheet

SENSOR LIGHT DEVICE

CROSS REFERENCE TO RELATED APPLICATIONS

This application claims the benefit of provisional application Ser. No. 60/425,141 filed Nov. 8, 2002.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to a warning device, and more particularly, to an automatic functioning light and warning sensor having a remote signaling device for use as an attachment to a mobility assistance device that assists geriatrics with the positioning of the mobility assistance equipment while reminding them to use the equipment. The invention may also be used for remote signaling of movement in the vicinity of the device.

2. Description of the Background Art

Senior citizens often suffer memory lapses and require assistance when walking. Without the aid of a reliable device or person to help them walk they can suffer injuries. Although certain devices are available to assist senior citizens, they are either improperly used or not used because of deteriorating memory. If there existed a device that could assist geriatrics with the proper use of mobility assistance equipment and remind them to use the equipment, it would be well received. An additional benefit not adequately addressed in the prior art is the ability to track use of equipment. Accordingly, there exist a need in the prior art for a device or system that assists geriatrics with the positioning of mobility assistance equipment while reminding them to use the device and for remotely signaling movement in the vicinity of the device. The instant invention addresses this unfulfilled need in the prior art by providing such a device and system.

BRIEF SUMMARY OF THE INVENTION

In light of the foregoing, it is an object of the present invention to provide a device that assist geriatrics with the positioning of mobility assistance equipment and reminds them to use the equipment.

It is another object of the present invention to provide a device that remotely signals movement in the vicinity of the device.

It is also an object of the present invention to provide a light sensor device that assist geriatrics with the use of mobility assistance equipment.

It is a further object of the present invention to provide a warning device that assist geriatrics with the use of mobility assistance equipment and tracks movement in the vicinity of the device.

It is an additional object of the present invention to provide an automatic functioning light and warning device and a remote signaling device as an attachment for a mobility assistance device.

It is yet another object of the present invention to provide a warning device for mobility assistance equipment.

It is yet a further object of the present invention to provide a remote signaling device for mobility assistance equipment.

In light of these and other objects, the instant invention comprises an automatic functioning light and warning system with remote signaling for use with mobility assistance devices. The invention may be used as an attachment to mobility assistance devices, such as wheelchairs and walkers. The invention comprises a housing, at least one detachable clamp connected to the housing, a battery-powered light incorporated into the housing, an internal audio alarm incorporated into the housing, an active or passive motion detection sensor and associated signal processing circuitry incorporated within the housing. The sensor light may use an ultrasonic or infrared transmitter and receiver combination as the motion sensor and may also incorporate a low power radio transmitter for remote signaling of motion near the sensor. The invention may use replaceable or rechargeable batteries as the power source. The remote receiver may be a stand alone device or interfaced into a monitoring system. A time delay circuit may be incorporated into the invention to automatically turn the light or alarm off at a predetermined time after activation. The light sensor prevents actuation when ambient light is above a predetermined threshold.

DETAILED DESCRIPTION OF THE INVENTION

Figure 1:
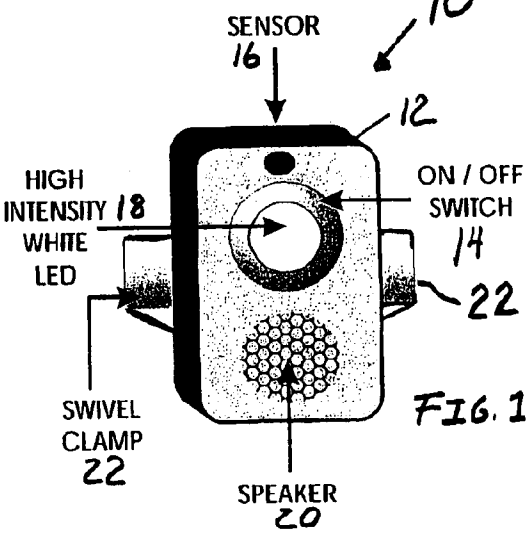
FIG. 1 is an elevational view of the preferred embodiment of the sensor light in accordance with the instant invention.
Figure 4:
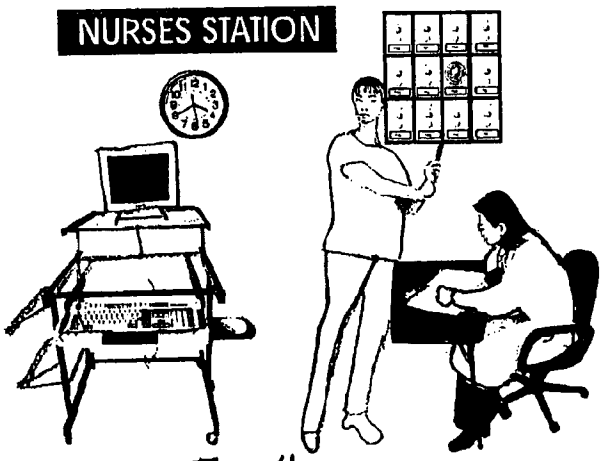
FIG. 4 is another illustrative view of the preferred embodiment of the sensor light in accordance with the instant invention shown in communication with a nurses station.

With reference to the drawings, FIGS. 1–4 depict the preferred embodiment of the instant invention which is generally referenced as a sensor light and, or by numeric character 10. With reference to FIG. 1, the sensor light 10 comprises a housing 12 for enclosing the transmitter and/or receiver circuitry, on/off switch 14, high intensity white LED 18, speaker 20 and swivel clamps 22. The sensor light 10 comprises an automatic functioning light and warning device having a remote signaling device used as an attachment for a mobility assistance device. The sensor light 10 features a detachable clamp 22 permanently connected to a battery powered light and alarm 18. The device 10 is actuated when there is motion in close proximity to an ultrasonic or infrared transmitter and receiver combination. The sensor light 10 assists geriatrics in determining the positioning of mobility assistance equipment while reminding them to use the equipment. The invention may also be used for remote signaling of movement in the vicinity of the device. The sensor light is designed to prevent geriatrics from injuring themselves by illuminating when motion is near the sensor while providing light to help in positioning of mobility assistance equipment.

Figure 2:
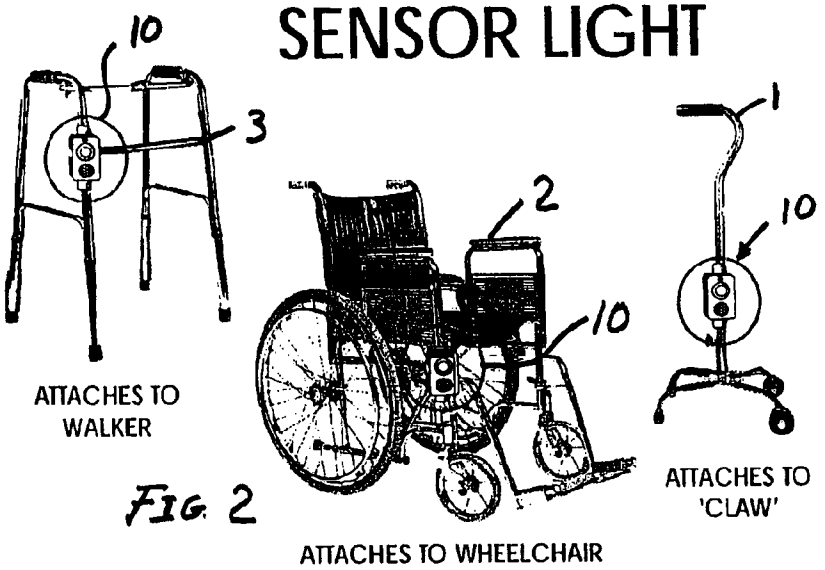
FIG. 2 and FIG. 3 are illustrative views of the preferred embodiment of the sensor light in accordance with the instant invention shown attached to various mobility assistance devices.
Figure 3:
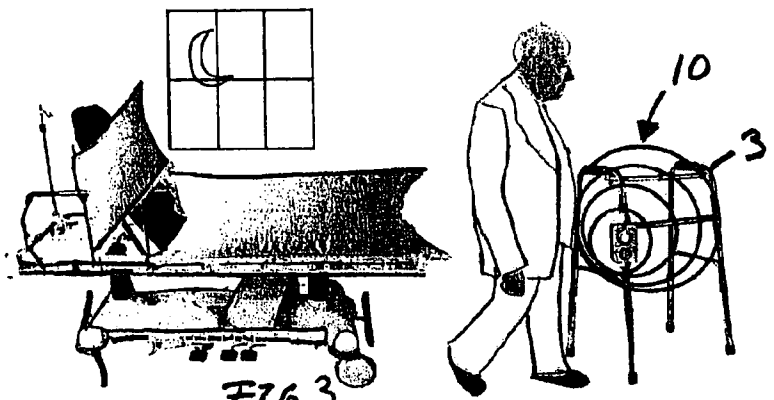

With reference to FIGS. 1 to 3, the sensor light 10 is an automatic functioning light and warning device having a remote signaling device. The invention may be used as an attachment to a mobility assistance device, such as those designated by numeric characters 1, 2 and 3 in the drawings. The invention has at least one detachable clamp 22 connected to the housing 12. The invention has a battery-powered light incorporated into the housing 12. The lighting device 10 may also have an internal audio alarm incorporated into the housing. The invention 10 has an active or passive motion detection sensor 16 and associated signal processing circuitry incorporated within the housing. The sensor light 10 may use an ultrasonic or infrared transmitter and receiver combination as the motion sensor 16. The invention 10 may use replaceable or rechargeable batteries as the power source. The sensor light 10 may also incorporate a low power radio transmitter for remote signaling of motion near the sensor 16. A remote receiver may be a "stand alone" device or interfaced into a monitoring system. The invention 10 may use rechargeable or replaceable batteries as the power source. The invention may incorporate a time delay circuit to automatically turn the light or alarm 18 off at a predetermined time after activation. The invention 10 may incorporate a light sensor 16 to prevent actuation when ambient light is above a predetermined threshold.

The sensor light 10 may be manufactured with a short-range radio transmitter to signal motion in the vicinity of the invention. Various methods of fastening the device to fixed or movable objects may be incorporated in the design.

The housing 12 and the attached clamp 22 of the sensor light 10 may be manufactured from plastic or metal. The light 18 incorporated in the housing 12 may be an incandescent lamp or an LED with the LED being the preferred illumination device. The incorporated electronics will be permanently attached to a polymer circuit board. The alarm may be a speaker, electromechanical buzzer, piezoelectric crystal or similar noisemaker. The device may use the housing or the object to which it is attached as a transmission antenna.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. An alarm device for mobility assistance equipment, to assist users with the positioning and use of the equipment to prevent or alleviate injuries to the users, said device comprising:

a housing;

means, connected to said housing, for connecting said housing to the equipment;

means for supplying electrical power;

a sensor, at least partially stored in said housing and in electrical communication with said power supply means, for selectively supplying power when triggered;

a light source, at least partially stored in said housing, in electrical communication with said sensor for illuminating at least a portion of the equipment when said sensor is triggered, wherein said light source is supplied with power when said sensor is triggered; and an alarm, at least partially stored in said housing, in electrical communication with said sensor for sounding said alarm when said sensor is triggered, wherein said alarm is supplied with power when said sensor is triggered whereby equipment comprises anyone of a wheelchair or walker.

2. A device as recited in claim 1, wherein said sensor comprises:

means for sensing motion in the vicinity of the equipment.

3. A device as recited in claim 1, further comprising means for signaling motion proximal said sensor, said signaling means comprising a short-range radio transmitter.

4. A device as recited in claim 1, wherein said connecting means comprises a clamp.

5. A device as recited in claim 4, wherein said clamp is detachable from said housing.

6. A device as recited in claim 1, wherein said power supply means comprises at least one battery.

7. A device as recited in claim 1, further comprising signal processing circuitry in said housing for electrically controlling and operating said sensor.

8. A device as recited in claim 3, further comprising signal processing circuitry in said housing for electrically controlling and operating said sensor and said motion sensor means.

9. A device as recited in claim 3, wherein said sensor comprises an infrared transmitter and receiver combination.

10. A device as recited in claim 3, wherein said sensor comprises an ultrasonic transmitter and receiver combination.

11. A device as recited in claim 1, further comprising means for signaling motion proximal said sensor, said signaling means comprising a low power radio transmitter.

12. A device as recited in claim 11, further comprising a remote receiver adapted for receiving and monitoring signals transmitted from said transmitter.

13. A device as recited in claim 1, further comprising a time delay circuit that automatically removes power from components in said device at predetermined time intervals.

14. A device as recited in claim 1, further comprising means for preventing actuation of said light source when ambient light is determined to be above a predetermined threshold.

15. A device as recited in claim 1, further comprising means for monitoring said device.

* * * * *